US005771654A

United States Patent [19]

Moore et al.

[11] Patent Number: 5,771,654

[45] Date of Patent: Jun. 30, 1998

[54] METHOD OF CONSTRUCTION USING MOLDED POLYMER BLOCKS

[75] Inventors: Dennis A. Moore, Dayton; Robert F. Freund, Waynesville; Fredric L. Abrams, Dayton, all of Ohio

[73] Assignee: Modern Technologies Corp., Dayton, Ohio

[21] Appl. No.: 339,485

[22] Filed: Nov. 14, 1994

[51] Int. Cl.[6] ..... E04B 2/24

[52] U.S. Cl. ..... 52/742.14; 52/437; 52/604; 52/606; 52/745.1; 52/747.12

[58] Field of Search ..... 52/742.14, 505, 52/607, 418, 425, 144, 316, 426, 606, 745.1, 747.12, 437, 604

[56] References Cited

U.S. PATENT DOCUMENTS

| | | | |
|---|---|---|---|
| Re. 34,314 | 7/1993 | Forsberg . | |
| 2,280,631 | 4/1942 | Coffey | 52/316 X |
| 3,281,510 | 10/1966 | Lovret | 52/607 |
| 4,319,440 | 3/1982 | Rassias et al. | 52/607 X |
| 4,577,447 | 3/1986 | Doran | 52/426 X |
| 4,614,071 | 9/1986 | Sams et al. . | |
| 4,633,639 | 1/1987 | Deimen . | |
| 4,731,279 | 3/1988 | Isshiki . | |
| 4,731,971 | 3/1988 | Terkl | 52/742.14 |
| 4,752,269 | 6/1988 | Feinstein . | |
| 4,771,584 | 9/1988 | Beard et al. . | |
| 4,789,369 | 12/1988 | Lyman . | |
| 4,825,619 | 5/1989 | Forsberg . | |
| 4,835,928 | 6/1989 | Scott . | |
| 4,852,321 | 8/1989 | Fleming, Jr. et al. . | |
| 4,854,097 | 8/1989 | Haener . | |
| 4,856,248 | 8/1989 | Larson et al. . | |
| 4,856,249 | 8/1989 | Nickerson . | |
| 4,860,515 | 8/1989 | Browning, Jr. | 52/426 |
| 4,877,656 | 10/1989 | Baskin . | |
| 4,879,855 | 11/1989 | Berrenberg | 52/426 X |
| 4,885,888 | 12/1989 | Young | 52/426 |
| 4,891,925 | 1/1990 | Carlson et al. . | |
| 4,892,699 | 1/1990 | Kudert et al. . | |
| 4,903,453 | 2/1990 | Newsom . | |
| 4,916,876 | 4/1990 | Schuyler . | |
| 4,944,907 | 7/1990 | Davis, Jr. . | |
| 4,956,030 | 9/1990 | Baskin . | |
| 5,033,245 | 7/1991 | Kline . | |
| 5,058,357 | 10/1991 | Newsom . | |
| 5,065,560 | 11/1991 | Yoder . | |
| 5,066,440 | 11/1991 | Kennedy et al. . | |
| 5,072,562 | 12/1991 | Crick et al. . | |
| 5,076,037 | 12/1991 | Crick et al. . | |
| 5,078,354 | 1/1992 | Kim . | |
| 5,086,600 | 2/1992 | Holland et al. | 52/426 X |
| 5,107,653 | 4/1992 | Lewis . | |
| 5,115,035 | 5/1992 | Shiraki et al. . | |
| 5,121,575 | 6/1992 | DeGarmo et al. . | |
| 5,134,817 | 8/1992 | Richardt . | |
| 5,160,273 | 11/1992 | Carney . | |
| 5,183,857 | 2/1993 | Shiraki et al. . | |
| 5,186,883 | 2/1993 | Beall, III . | |
| 5,199,919 | 4/1993 | Glickman . | |
| 5,209,037 | 5/1993 | Kennedy et al. . | |
| 5,215,027 | 6/1993 | Baxter . | |
| 5,221,702 | 6/1993 | Richards . | |
| 5,229,145 | 7/1993 | Brown et al. . | |
| 5,233,810 | 8/1993 | Jennings . | |
| 5,261,205 | 11/1993 | Sandor . | |
| 5,268,137 | 12/1993 | Scott et al. . | |
| 5,272,208 | 12/1993 | Shiraki et al. . | |
| 5,272,209 | 12/1993 | Shiraki et al. . | |
| 5,274,968 | 1/1994 | Pardo . | |
| 5,277,609 | 1/1994 | Ondrejka . | |
| 5,278,246 | 1/1994 | Shiraki et al. . | |
| 5,285,610 | 2/1994 | Schaaf et al. . | |
| 5,367,845 | 11/1994 | Hartling | 52/742.14 X |

*Primary Examiner*—Christopher Kent
*Attorney, Agent, or Firm*—Jacox. Meckstroth & Jenkins

[57] ABSTRACT

A method wherein structures can be assembled using blocks that form a lattice network which can be filled with a reinforcing material, said blocks being capable of serving as a permanent form that provides a finished exterior surface.

10 Claims, 12 Drawing Sheets

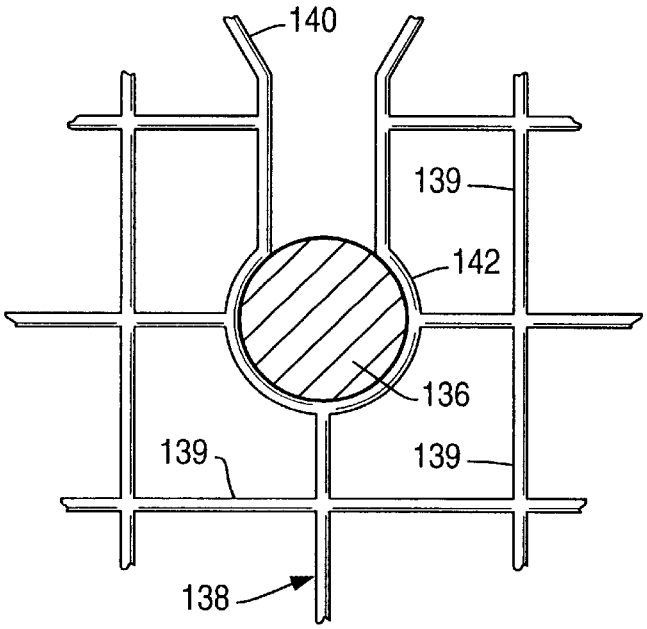
FIG. 16
FIG. 18
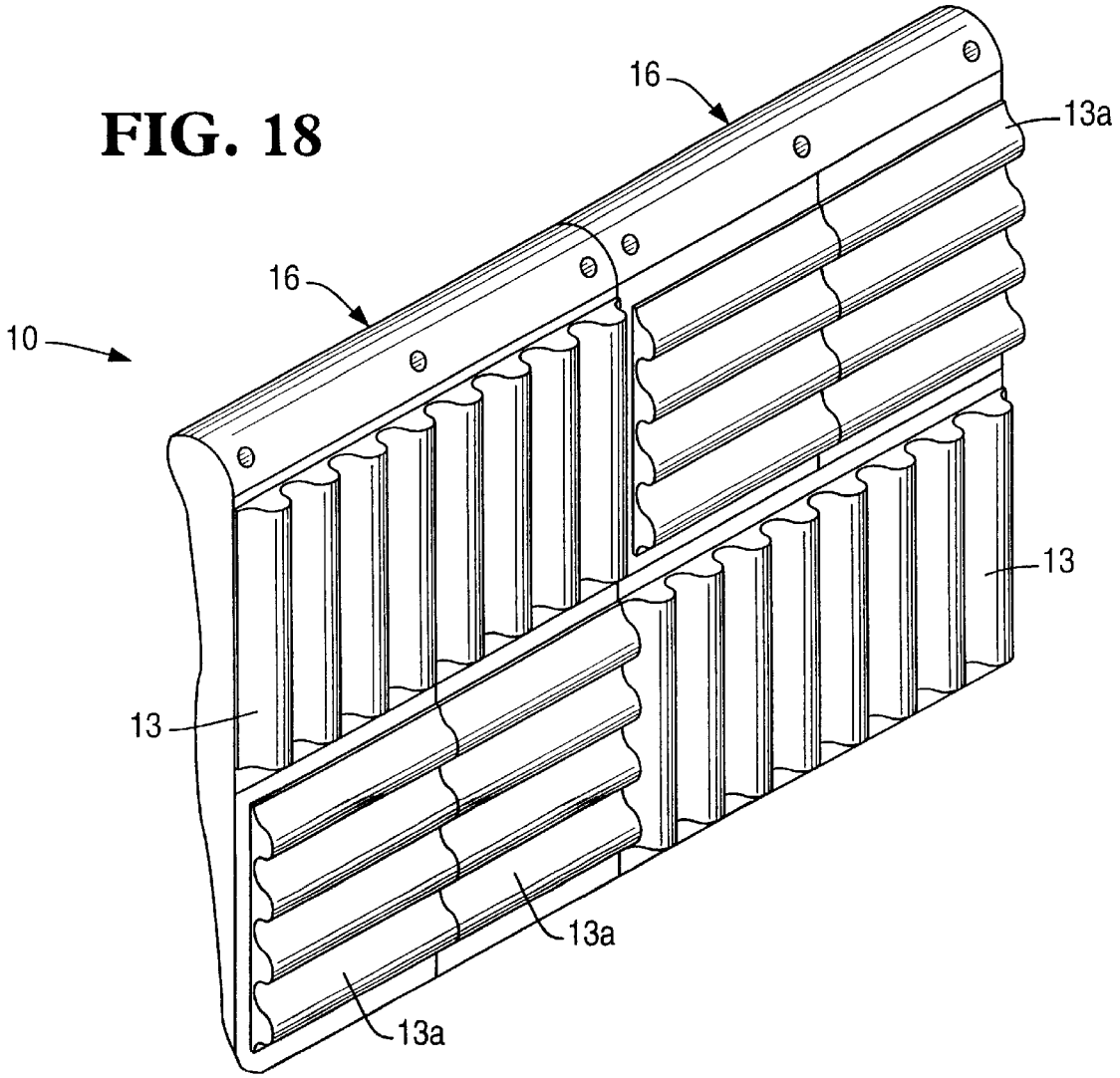

METHOD OF CONSTRUCTION USING MOLDED POLYMER BLOCKS

BACKGROUND OF THE INVENTION

1. Field of the Invention

The present invention relates to a construction system and, more particularly, to a construction system employing a plurality of block members which have a predetermined passage portion, the plurality of block members being interconnected to provide a structure with a predefined lattice system capable of receiving a material which cooperates with the plurality of block members to enhance at least one structural characteristic of the structure.

2. Description of Related Art

A number of basic structures, such as walls, supports and barriers, as well as enclosed structures like buildings where walls form a substructure thereof, are commonly constructed of large pre-cast concrete slabs that may be connected together. It has been found, however, that such slabs are difficult to transport and maneuver into position due to their weight. Accordingly, one alternative for building such structures has been the utilization of forms at the construction site which are then filled with concrete or other material. While alleviating some disadvantages of the concrete slabs previously mentioned, the use of forms is very labor intensive and time consuming since such forms must not only be built up prior to pouring the concrete, but also must then be removed after the concrete has hardened. In this type of construction system, the concrete may act as the entire structure with its exterior surface being exposed to environmental influences and the threat of graffiti.

Such walls may also be constructed using pre-cast concrete blocks, which are assembled by placing mortar between all abutting surfaces of adjacent blocks. The material expense and labor involved in wall construction using this approach is generally considered unacceptable, which is a principal reason for the aforementioned pre-cast concrete slabs being employed in many instances.

In an attempt to circumvent at least some of the aforementioned problems, non-concrete block systems have been utilized in the art. Such systems are able to address the weight related problems of concrete slabs, as well as the expense and labor required for constructing forms and assembling concrete blocks, but the non-concrete block systems have typically utilized styrofoam or other material which, when left in place, are inappropriate for the finished exterior of a structure. An inherent feature of such non-concrete block systems has been the need to either erect extensive shoring or build up the structure slowly since the blocks are unable to satisfactorily contain the weight of the poured concrete for a very large area. Once again, it will be understood that such non-concrete blocks must be covered with another material to form the finished structure, including the exterior surface thereof.

Thus, a need exists in the art for a construction system which acts not only as a form for a material such as concrete, but also is an integral part of the structure and is better able to serve as the structure's exterior surface. Moreover, it would be desirable if such a construction system could use less concrete while still maintaining generally the same level of structural integrity.

SUMMARY OF THE INVENTION

In accordance with one aspect of the present invention, a construction system is disclosed in the form of a plurality of block members which each have a predetermined passage portion, the plurality of block members being interconnected to provide a structure with a predefined lattice system capable of receiving a material which cooperates with the plurality of block members to enhance at least one structural characteristic of the structure. The block members are constructed of a single unitary member or a plurality of matable block components.

An object of the present invention is to provide a system and method for constructing a structure, such as a wall, which utilizes less concrete than structures of the past.

Another object of the present invention is to provide a system and method for constructing a structure which has internal passageways configured and situated to improve the structural integrity of the structure.

Another object of the present invention is to provide a system and method for constructing blocks for a structure, such as a wall, which may be molded from recycled materials.

Still another object of the invention is to provide a system and method which provides an exterior surface which is easier to maintain than surfaces of the past.

Still another object of the present invention is to provide a system and method for expediting the construction of a wall.

These objects, advantages and others will become more readily apparent from the following detailed description, drawing and appended claims.

BRIEF DESCRIPTION OF THE DRAWINGS

While the specification concludes with claims particularly pointing out and distinctly claiming the present invention, it is believed that the same will be better understood from the following description taken in conjunction with the accompanying drawing in which:

FIG. 16 is a front view of a rebar support insert positionable in the interconnected passages depicted in FIG. 2;

FIG. 18, which is located on the same sheet as FIG. 16, is a partial perspective view of a structure made in accordance with the construction system of the present invention depicting the ability of the block members to be oriented in different directions.

DETAILED DESCRIPTION OF THE INVENTION

Figure 1:
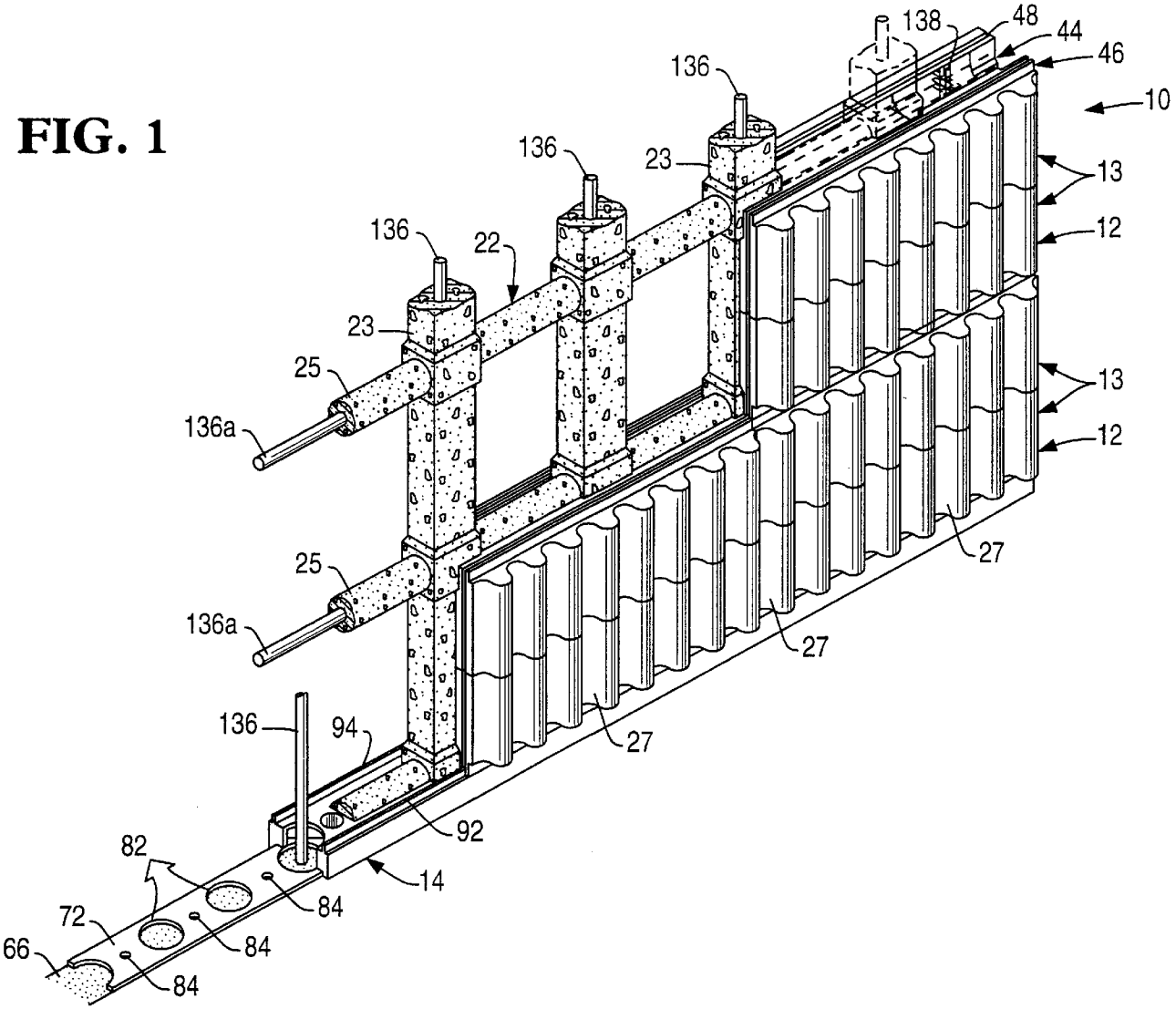
FIG. 1 is a partial perspective view of a structure made in accordance with the construction system of the present invention, where a portion has been broken away to show the lattice of vertical and horizontal columns formed in the interconnected passages by the material provided therein.

Referring now to the drawings in detail, wherein identical numerals indicate the same elements throughout the figures, FIG. 1 depicts a partially completed structure 10 made in accordance with the construction system of the present invention. As seen therein, structure 10 is constructed of a plurality of assembled block members 12, with each block member 12 preferably being interlocked with all adjacent block members as described hereinafter. It will be understood that block members 12 may be interlocked both horizontally and vertically so as to construct a structure of desired width and height. Structure 10 will also preferably include a plurality of aligned base members 14 to which the first level of block members 12 will be connected, as well as a plurality of end cap members 16 positioned along the top and sides of structure 10 (see FIG. 3).

Figure 2A:
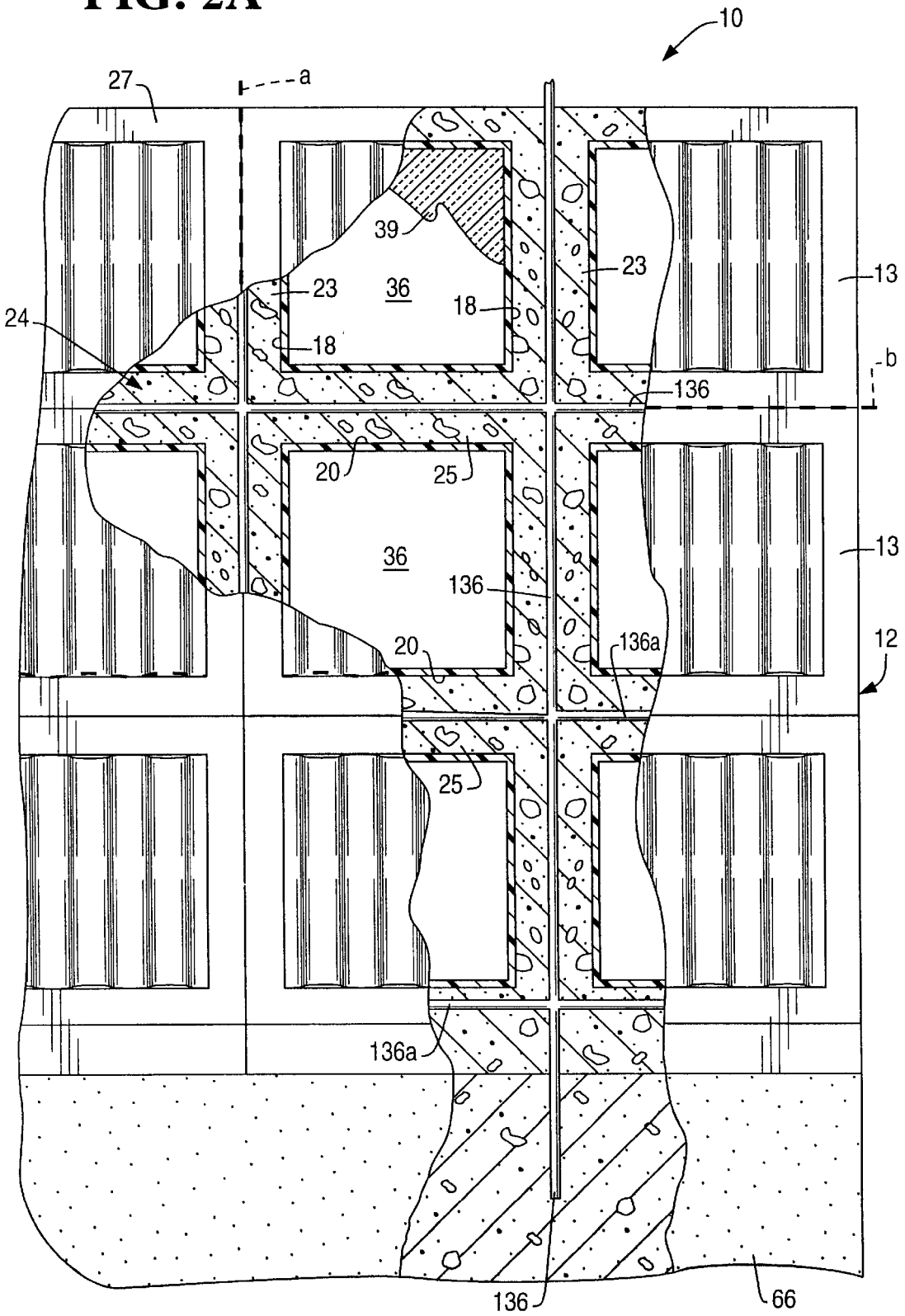
FIG. 2A is a front view of a structure like that of FIG. 1 made in accordance with the construction system of the present invention, where a portion has been broken away to also show the lattice of vertical and horizontal columns located within interconnected passages of assembled block members.

More specifically, it will be understood that, as best seen in FIG. 2A, a network of interconnected passages is formed within structure 10 by the assembly of block members 12. Preferably, such network of interconnected passages will take the form of a series of spaced vertical passages 18 and a series of spaced horizontal passages 20 which, when filled with a material 24, form a plurality of interconnected vertical columns 23 and horizontal columns 25 which in turn results in a lattice or grid 22. It is intended that vertical columns 23 and horizontal columns 25 are provided in order to enhance at least one structural characteristic (e. g., strength, elasticity) the assembled block members 12 comprising structure 10, as shown in FIG. 1.

Typically, material 24 will be concrete or other similar material which may be poured or pumped into structure 10, such as through the top of vertical passages 18, whereupon block members 12 simultaneously act as forms for lattice 22 and as an integral part of structure 10. It will be specifically noted that structure 10 is constructed of both block members 12 and material 24, whereby the desirable characteristics inherent to each may be utilized. In particular, block members 12 forming the exterior of structure 10 are preferably made of a plastic material which can be cleaned easily with a solution if subjected to graffiti. of course, it will be understood that materials other than concrete (e. g., polymer cementitious material, insulation, rubber, wood, glass or paper) may be utilized as material 24 within passages 18 and 20 depending upon the particular application.

Figure 2B:
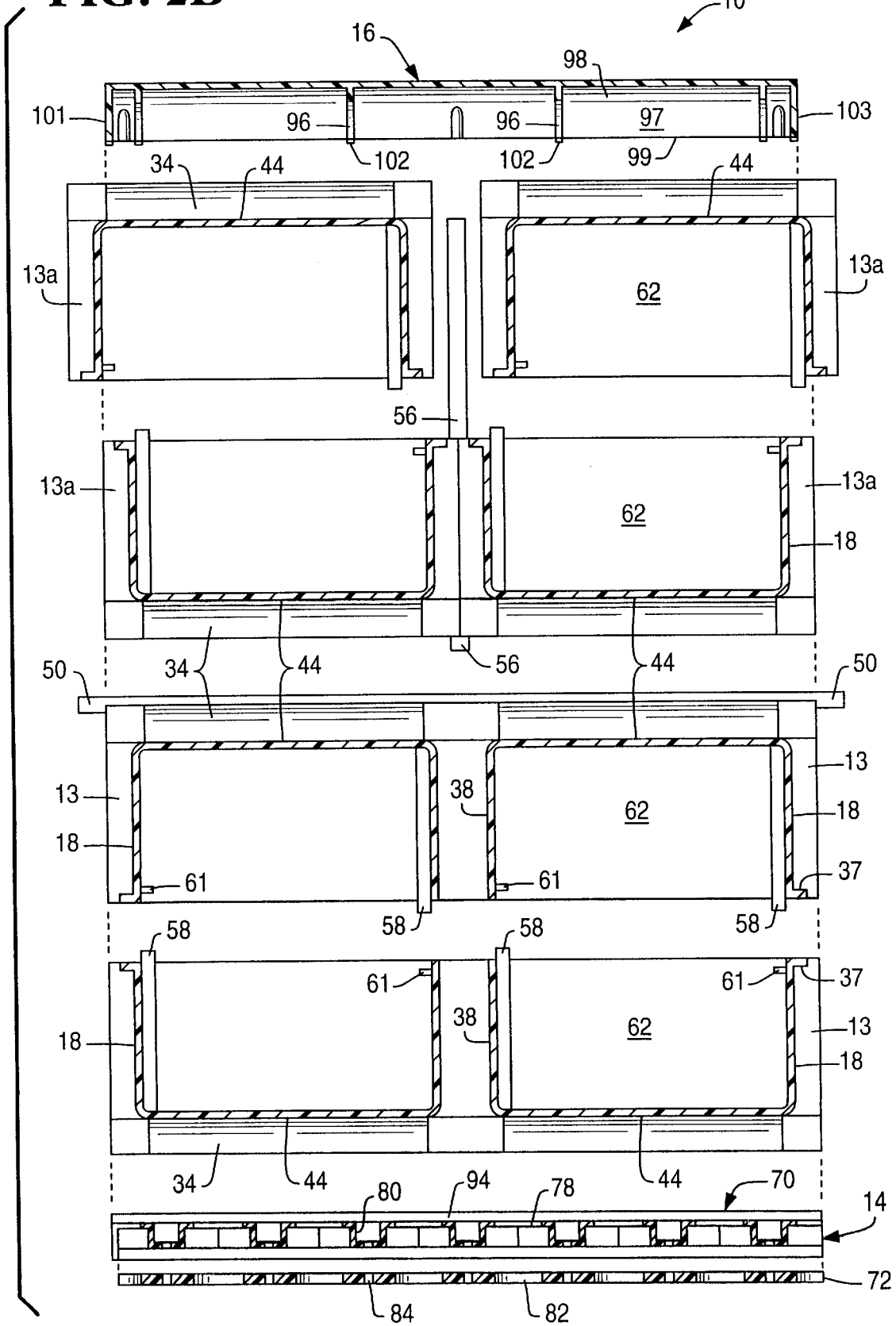
FIG. 2B is a partial, exploded front cross=-sectional view of a structure like that of FIG. 1 made in accordance with the construction system of the present invention showing both the mating of adjacent block components and the vertical and horizontal interlocking of adjacent block members.
Figure 3:
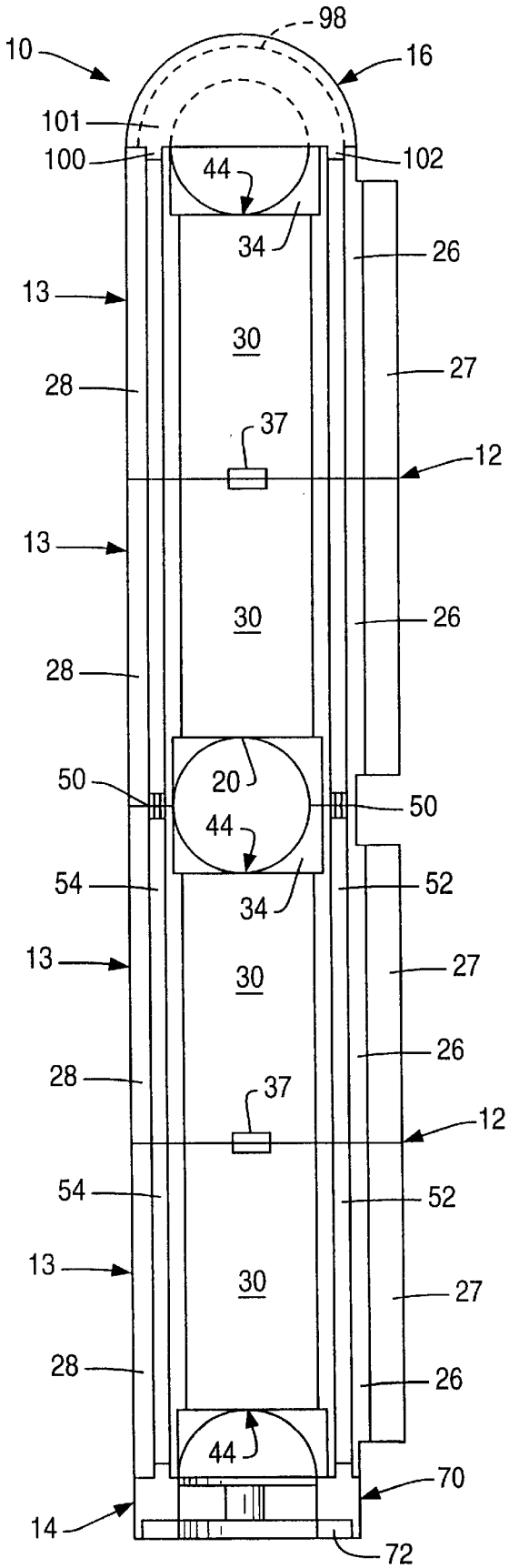
FIG. 3 is a side view of the structure depicted in FIG. 2B, where the adjacent block components have been mated and the adjacent block members have been interlocked.

It will be understood that block members 12 may be a single, unitary member or constructed of a plurality of block components 13 mated together as depicted in FIGS. 1, 2B and 3. Preferably, block members 12 are made up of two block components 13 which are substantially symmetrical halves of a block member 12. In this way, block components 13 can be of the same design to increase production efficiency.

As seen in FIGS. 5–8, each block component 13 includes a front wall 26, a rear wall 28, a pair of side walls 30 and 32, and a wall 34 connecting front, rear, and side walls 26, 28, 30 and 32, respectively. Accordingly, an interior space or void, designated generally by the numeral 36, is defined between the walls of block component 13. It will be understood that the numerals utilized with respect to identifying portions of block components 13 also are applicable to block members 12 since block components 13 are merely a part of an overall block member 12.

Figure 5:
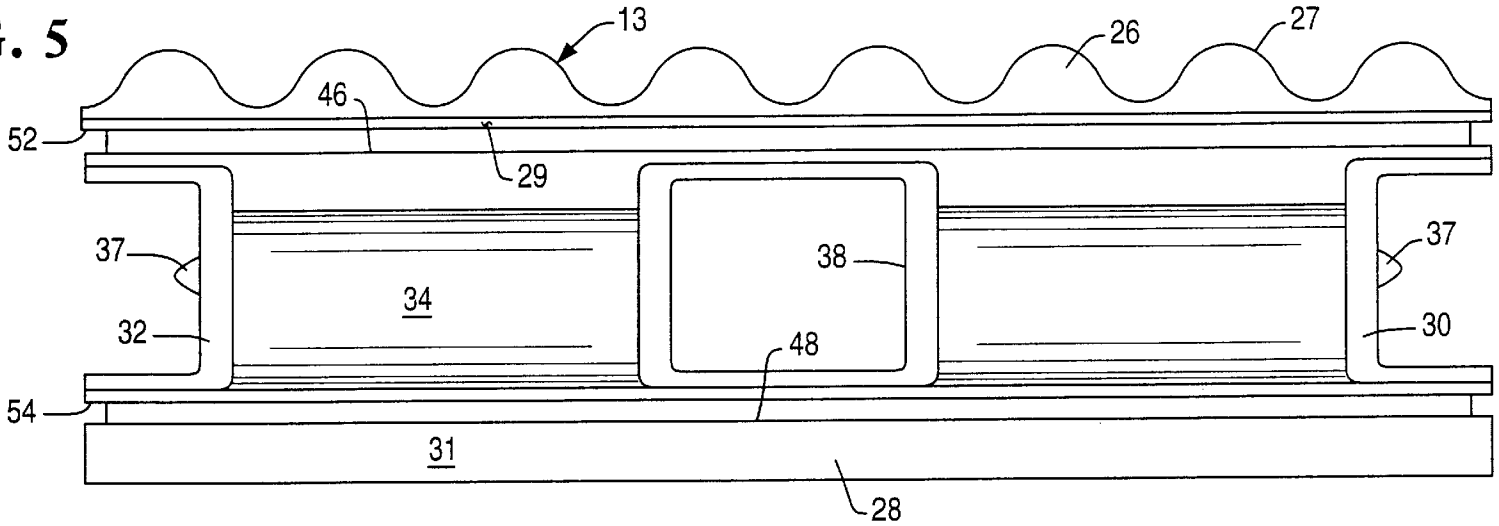
FIG. 5 is a top view of an individual block component of the construction system of the present invention.
Figure 6:
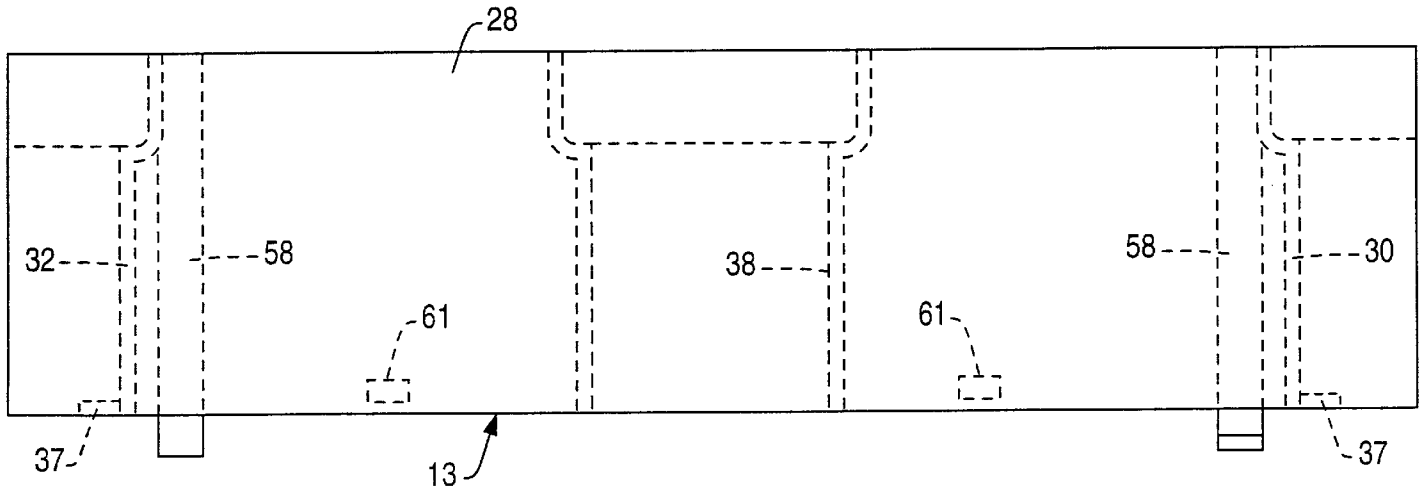
FIG. 6 is a front view of the block component depicted in FIG. 5.
Figure 7:
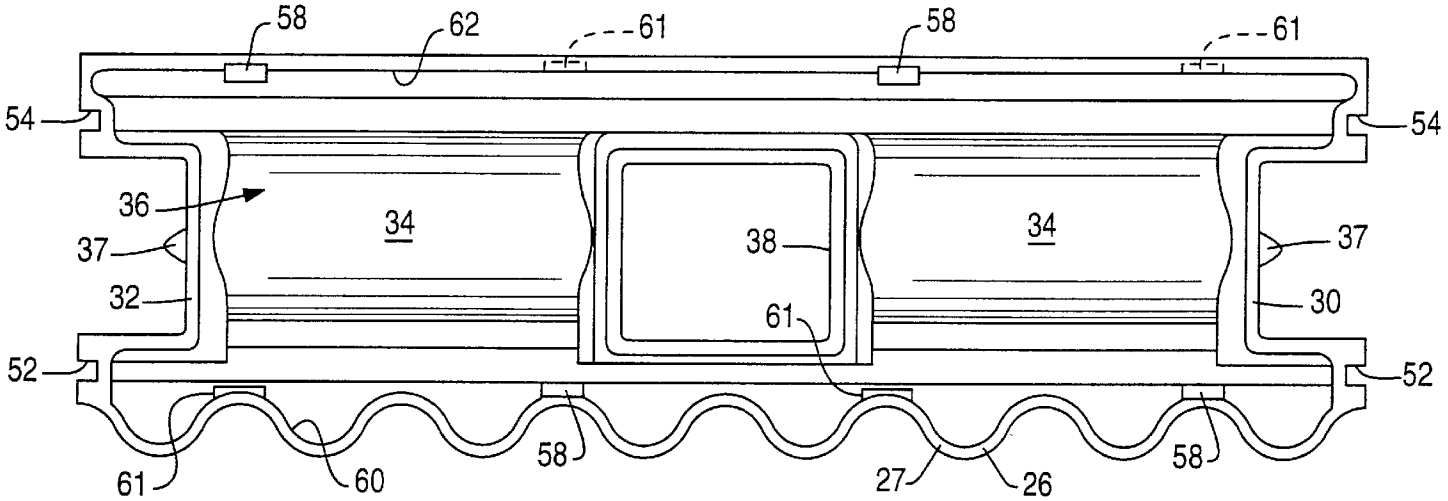
FIG. 7 is a bottom view of the block component depicted in FIGS. 5 and 6.

As seen best in FIGS. 5–7, a defined passage 38 may be provided through connecting wall 34 and interior space 36 of block component 13. Although block component 13 is oriented in FIGS. 1, 2B and 3 so that passage 38 is a part of a vertical passage 18 in structure 10, it will be understood that block component 13 may alternatively be oriented whereby passage 38 would be a part of a horizontal passage 20 in a structure (see FIG. 18, for example). Also, passage 38 as depicted is substantially rectangular in cross-section, but may be circular or any other desired shape.

It will also be seen that, depending upon the width of block member 12 and the desired spacing between adjacent passages in structure 10, side walls 30 and 32 may be non-planar. Preferably, side walls 30 and 32 will be approximately one-half the shape and size of passage 38 so that a passage of like shape and size will be formed when the side wall of an identically shaped adjacent block component or block member is interlocked thereto. As seen best in FIGS. 5 and 7, side walls 30 and 32 are substantially U-shaped so that a substantially rectangular passage will be formed when mated with an adjacent side wall.

Figure 4:
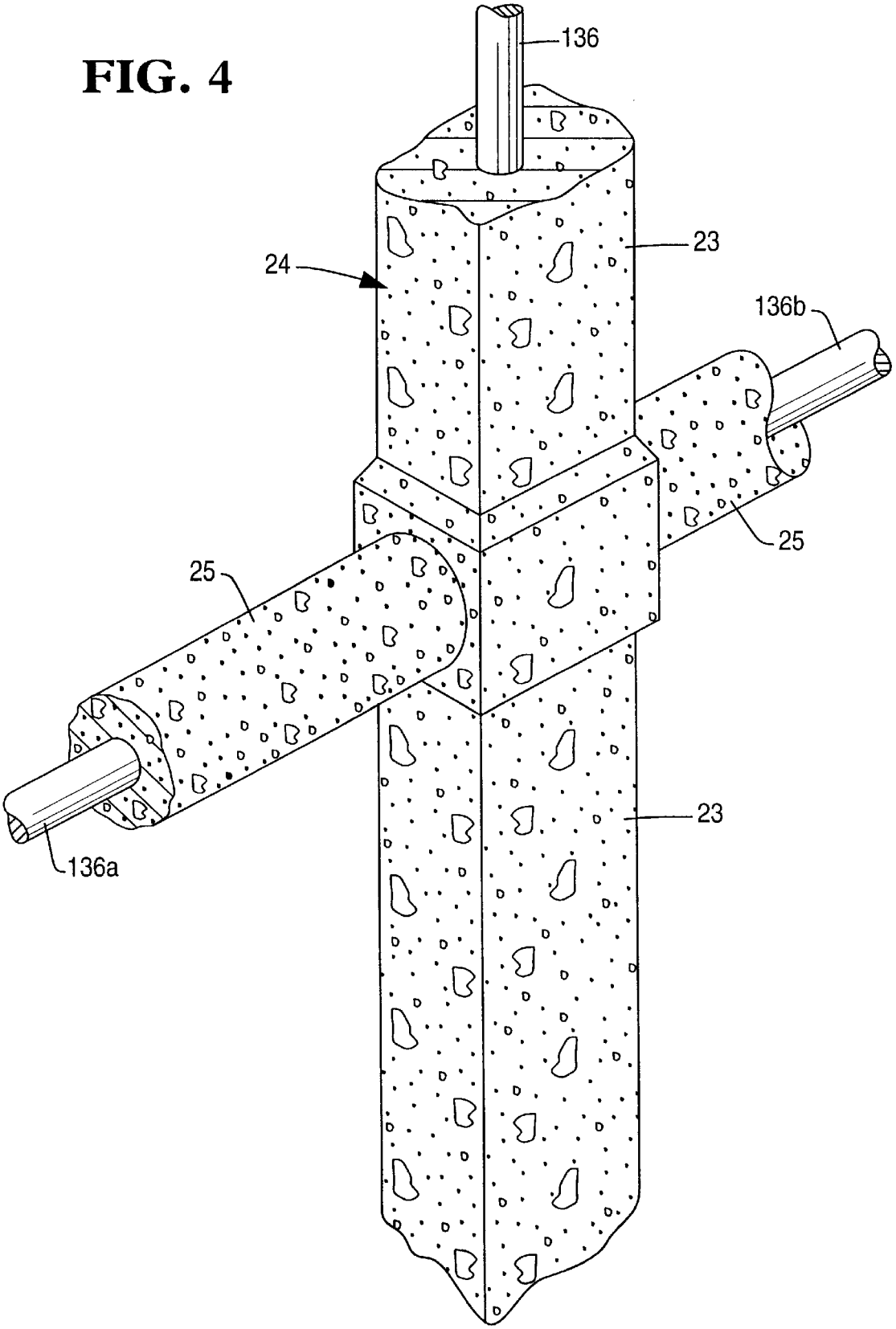
FIG. 4 is an enlarged partial perspective view of the intersection between a vertical and a horizontal column in the lattice structure depicted in FIG. 1.
Figure 8:
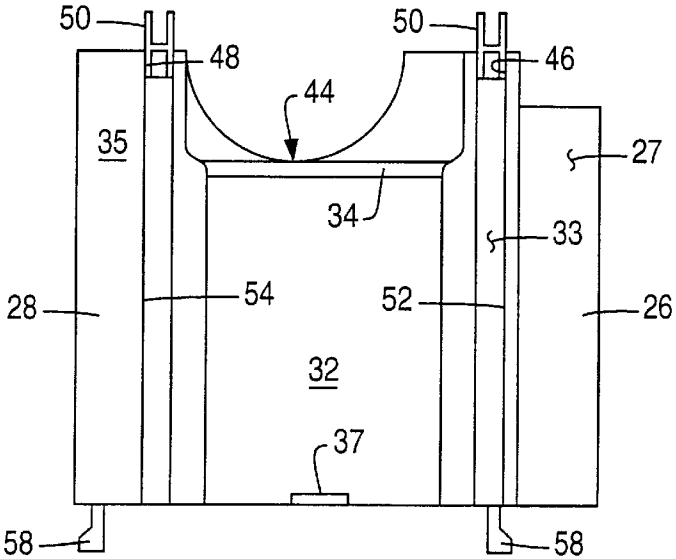
FIG. 8 is a side view of the block component depicted in FIGS. 5–7.
Figure 9:
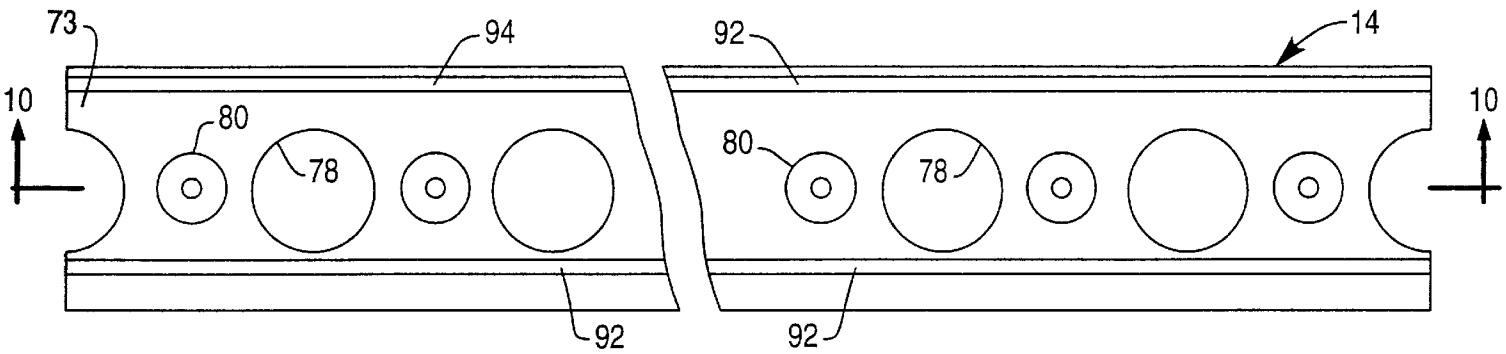
FIG. 9 is a top view of a base member of the construction system of the present invention.
Figure 10:
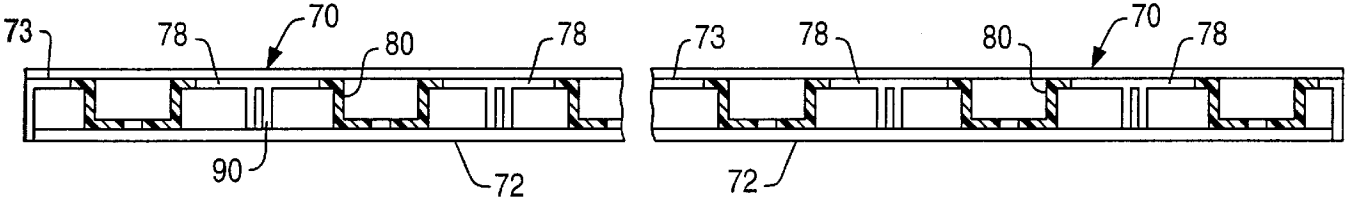
FIG. 10 is a cross-sectional front view of the base member depicted in FIG. 9 taken along line 10—10 of FIG. 9.
Figure 11:
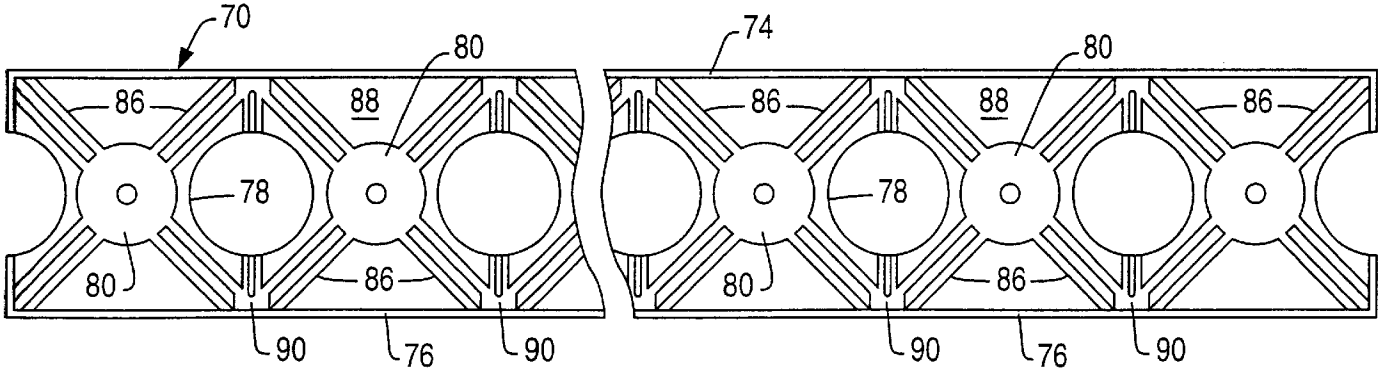
FIG. 11 is a bottom view of the upper portion of the base member depicted in FIGS. 9 and 10.

As seen in FIG. 8, block components 13 also include a channel 44 extending longitudinally thereacross formed by front wall 26, rear wall 28, and connecting wall 34. It will be understood that when block component 13 is mated with an adjacent block component, channels 44 for each respective block component will together form one of the interconnecting passages in block member 12 intersecting passage 38, such as a horizontal passage 20 described hereinabove (see FIG. 2B). Although connecting wall 34 is depicted as being substantially semi-cylindrical so that channel 44 is of like shape, any other suitable shape may be utilized. The main advantage of having channel 44 being semi-cylindrical, and therefore the passage formed by two adjacent channels 44 being cylindrical, is the chamfer effect between intersecting columns, such as vertical columns 23 and horizontal columns 25 (see FIG. 4). This construction strengthens the intersection of columns in structure 10 and the overall lattice 22 formed therefrom. Also, it should be noted that centerline a of passage 38 and centerline b of the completed passage formed by mated channels 44 are preferably offset just as the centerlines of vertical and horizontal passages 18 and 20 are offset, so that tie rod elements incorporated in the centers of horizontal and vertical columns 25 and 23, as discussed hereinafter, do not interfere with each other.

As stated above, block members 12 may be constructed of mated adjacent block components 13. This mating may be accomplished in any number of ways, but a tongue and groove configuration as seen in FIG. 3 is preferred. More specifically, a pair of longitudinal grooves 46 and 48 are formed within surfaces 29 and 31 of front and rear walls 26 and 28, respectively, adjacent to each side of channel 44 for each block component 13. Accordingly, block components 13 are mated by positioning individual connecting members 50 within grooves 46 and 48 of one block component and aligning another block component so that its respective grooves are able to be press fit onto connecting members 50, whereby surfaces 29 and 31 of front and rear walls 26 and 28 of both block components are locked in an abutting relationship and form a block member 12 (see FIG. 3). If desired, a bead of adhesive or other material may be positioned adjacent grooves 46 and 48 to effect an additional seal between block components 13.

It will be understood, as seen in FIGS. 2B, 3 and 8, that connecting members 50 are a strip of plastic or other suitable material having a width dimensioned for a press or friction fit within grooves 46 and 48. Preferably, connecting members 50 will have an "H" cross-section, where the parallel legs thereof are able to be compressed together within grooves 46 and 48.

As stated previously, adjacent block members 12 are preferably interlocked both horizontally and vertically. In this regard, grooves 52 and 54 are preferably provided within surfaces 33 and 35 of front and rear walls 26 and 28, respectively (see FIG. 8). It will be understood that like grooves are also formed on surfaces in front and rear walls 26 and 28 opposite surfaces 33 and 35, but not shown. For block members 12 positioned side by side, connecting members 56 having the same or similar configuration as connecting members 50 are positioned within grooves 52 and 54 of each adjacent block member to form an interlock along each side of block member 12. It will be noted that if a block member 12 is turned approximately 90° with respect to an adjacent block member, as seen in FIG. 18, grooves 46 and 48 in surfaces 29 and 31 may be mated with grooves 52 and 54 of surfaces 33 and 35.

Further, block members 12 include a plurality of detent members 58 integrated on interior surfaces 60 and 62, respectively, of front and rear walls 26 and 28 of block components 13. Positioned between each detent member 58 is a slot 61 incorporated into interior surfaces 60 and 62, which is sized to retain detent member 58. It will be seen that detent members 58 of rear wall 28 align with slots 61 of front wall 26 and detent members 58 of front wall 26 align with slots 61 of rear wall 28. In this way, adjacent block members 12 may be interlocked by placing detent members 58 of one block member within slots 61 of the other and vice versa.

In addition, tabs 37 may be provided which extend outwardly from side walls 30 and 32, preferably being located in approximately the same plane as slots 61. It is intended that a connecting device, such as a drywall screw, be utilized to connect tabs 37 of adjacent block members 12 to assist in securing the interlock therebetween.

It is important to note that when two block components 13 comprise block member 12 the manner utilized for interlocking adjacent block components 13 along front and rear walls 26 and 28 will alternate between the groove/connecting member configuration and the detent/slot arrangement as rows of block members 12 are constructed (see FIG. 2B). By doing so, it allows a substantially uniform design for block components 13 to be utilized in the construction of structure 10, thereby requiring only one mold for block component 13.

While FIGS. 5–8 depict a preferred configuration of block components 13, and FIG. 1 shows block components 13 being of substantially the same dimensions, such block components may be of different sizes. In particular, it is contemplated that some block components 13*a* (see FIG. 2B) be approximately one-half the length of block component 13 described with respect to FIGS. 5–8, with all other features being the same except for the elimination of passage 38 (i.e., block component 13 is divided in half lengthwise). This differentiation in size is noteworthy because it allows the joints formed by adjoining block components to be staggered adjacent vertical columns 23 formed in vertical passages 18, for example.

As can be easily understood, it is desirable to have the height and width of the block components to remain the same, although these can be made bigger or smaller so long as they remain common multiples of the dimensions for block component 13. It is also highly desirable for the height and width of block components 13 to have a common multiple with the length (e.g., length=32 inches or 16 inches; height=8 inches; width=8 inches).

It will also be seen that front wall 26 of block members 12 and block components 13 may have an exterior surface 27 which is either planar, non-planar, textured, or deeply dimensional. As seen in FIGS. 1 and 18, for example, external surface 27 of front wall 26 has an anechoic baffle of reflection curved design which has been found to be particularly effective in acting as a sound baffle. Of course, the desired textures may either be inherent to front wall 26 or molded to exterior surface 27 thereof. Further, block members 12 are made of a material which will accept and hold attachments devices such as screws, whereby other finishing materials or masonry facia may be affixed to front and rear walls 26 and 28. Therefore, the front exterior surface 27 of structure 10 formed by block members 12 (as well as any other wall or surface) is able to accommodate any number of designs due to the inherent flexibility of the injection molding process and the material utilized for block members 12.

In order to further enhance the integrity of structure 10, it would be useful to attach structure 10 to a footer 66 (see FIGS. 1 and 2A) or other foundation as commonly done in the construction industry. To facilitate the attachment of structure 10 to footer 66, a base member 14 (as depicted in FIGS. 1–3 and 9–11) may be utilized. As seen therein, base member 14 includes an upper portion 70, which is substantially U-shaped in cross-section having legs 74 and 76 and a planar connecting member 73, as well as a substantially planar lower portion 72 fitting between legs 74 and 76 of upper portion 70. Planar member 73 is substantially parallel to lower portion 72 and has a plurality of openings 78 therethrough as well as a plurality of chamfer-shaped openings 80 positioned between openings 78. It will be understood that openings 78 will align substantially with vertical passages 18 within structure 10 so that material 24 is able to extend from the top of structure 10 to base member 14 as best seen in FIG. 1. Chamfer-shaped openings 80 are provided for fasteners to attach base member 14 to footer 66, such as by a cartridge actuated fastener driver.

Correspondingly, lower portion 72 of base member 14 also includes openings 82 and 84 therein which conform to openings 78 and 80 of upper portion 70, respectively, and will be aligned therewith. It will be noted that reinforcing ribs 86 are provided on an interior surface 88 of planar member 73 of upper portion 70, where they preferably extend radially from chamfer openings 80 in an "X" configuration between a series of reinforcement ribs 90 extending between legs 74 and 76 of upper portion 70 and openings 78 in planar member 73. In this way, base member 14 is better able to provide the desired support to structure 10.

It will further be noted that upper portion 70 of base member 14 includes a pair of raised ridges 92 and 94 extending longitudinally thereacross located on each side of openings 78 and 80. Raised ridges 92 and 94 are spaced and sized to be press fit within grooves 46 and 48 in surfaces 29 and 31 of front and rear walls 26 and 28 of block components 13, as well as grooves 52 and 54 in surfaces 33 and 35 of front and rear walls 26 and 28, respectively. Accordingly, irregardless of the orientation of a block component 13 or block member 12 to base member 14, it may be interlocked with base member 14.

Figure 12:
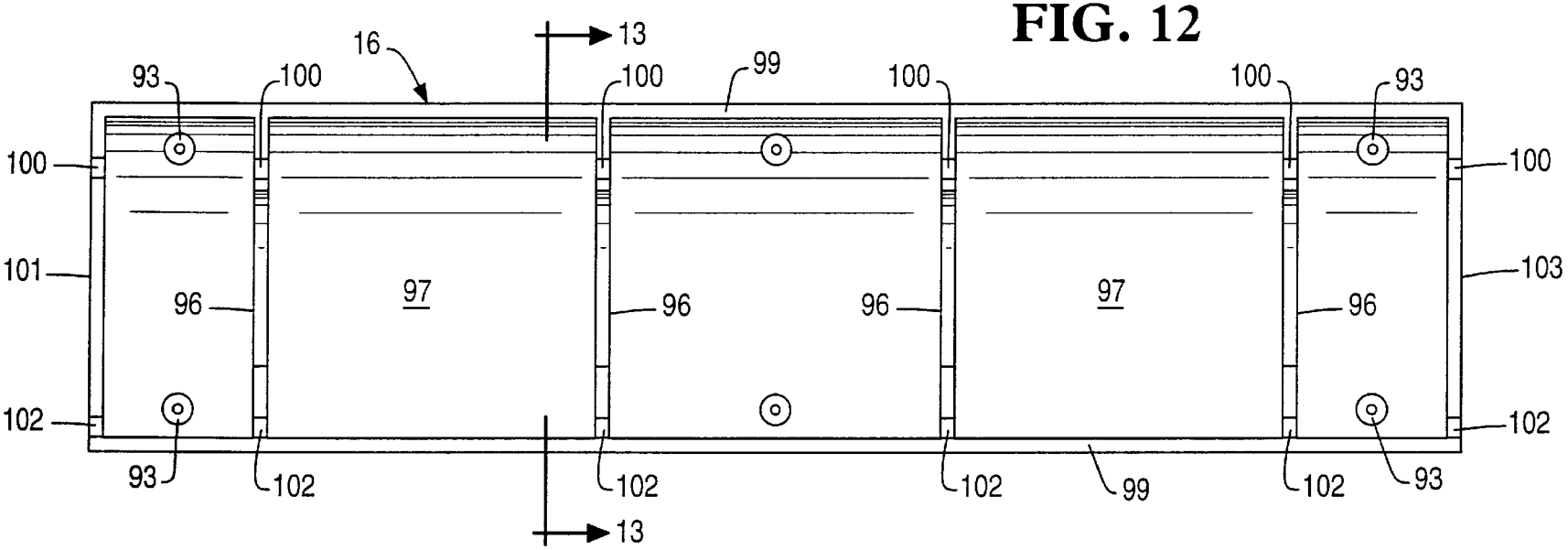
FIG. 12 is a bottom view of an end cap member of the construction system of the present invention.
Figure 13:
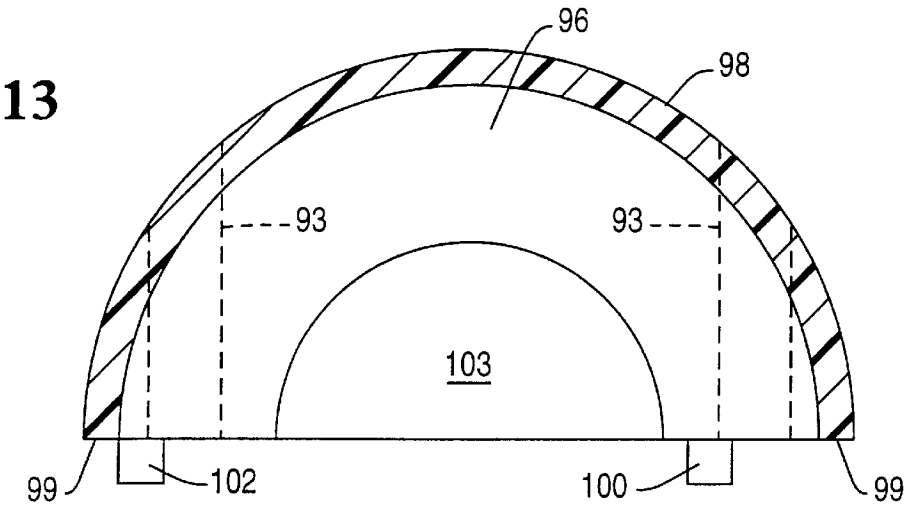
FIG. 13 is a cross-sectional side view of the end cap member depicted in FIG. 12 taken along lines 13—13 of FIG. 12.

As mentioned previously, end cap members 16 may be utilized along the exterior edges of structure 10, such as along the sides and top thereof. As seen in FIGS. 12 and 13, each end cap member 16 is preferably substantially semi-circular in cross-section (but is not limited thereto) and has a plurality of supports 96 attached to an inner surface 97 of an annular wall 98 thereof. Side walls 101 and 103 are provided at each end of annular wall 98 of end cap member 16 in order to define an interior space therebetween.

As seen in FIG. 13, each support 96 is substantially semi-circular in shape (conforming to the shape of end cap member 16) and includes a pair of flanges 100 and 102 which extend past edges 99 of annular wall 98. It will be understood that flanges 100 and 102 have a width sized substantially the same as that of connecting members 50 and 56 in order to provide the same friction fit within grooves 46, 48, 50 and 52 of front, rear and side walls 26, 28, 30 and 32, respectively. As seen in FIGS. 12 and 13, a number of passages 93 are provided in annular wall 98, whereby a fastener may be inserted therein and retained in front and/or rear walls 26 and 28 at surfaces 29 and 31 or surfaces 33 and 35, depending on the orientation of block member 12 with respect to end cap member 16. By attaching end cap members 16 to structure 10, interior passageways 18 and 20 thereof, as well as vertical and horizontal columns 23 and 25 when material 24 is provided, may be protected from environmental influences and debris. Additionally, end cap members 16 increase the aesthetic appearance of structure 10.

It will be understood that block members 12, block components 13, base members 14, and end cap members 16 are preferably formed of a plastic material and optimally of recycled plastic such as polyethylenes, polypropylenes or other commingled polyolefins. Such plastic may be melted and injection molded in a properly constructed mold or die so that each block member 12, block component 13, base member 14, and end cap member 16 is a single unitary element. Alternatively, block members 12, block components 13, base members 14, and end cap members 16 may be structural foam molded.

In accordance with the previous description of the inventive construction system, it is seen that a structure constructed in such manner not only has acceptable integrity but utilizes less concrete or other filler material than previous systems. Also, by constructing the structure with non-concrete block members of the present invention, the exterior surfaces thereof are easier to maintain. The interlocking mechanisms of the present invention further provide the advantage of expediting assembling of adjacent block members and block components and consequently the overall structure, thereby reducing labor and expense.

Figure 14:
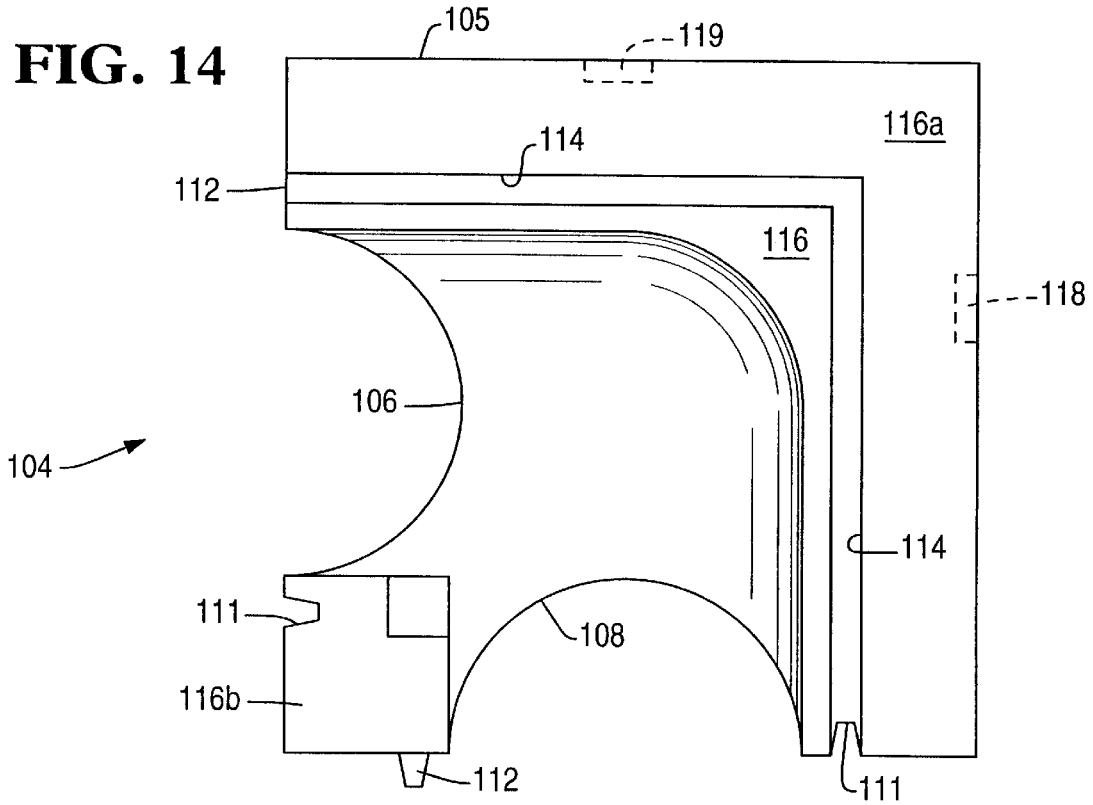
FIG. 14 is a top view of a corner block member of the construction system of the present invention.

As seen in FIG. 1, structure 10 is seen to be a simple wall. However, the construction system of the present invention may be utilized to construct more complex structures depending upon the design or configuration of block members 12, including enclosed structures such as building or house. Since such structures will normally involve the use of a plurality of interconnected walls, it is contemplated that a corner block component 104 as shown in FIG. 14 would be desirable. As seen therein, corner block component 104 has four walls, with walls 105 and 107 being substantially planar and walls 106 and 108 being non-planar. Non-planar walls 106 and 108 will generally conform to side walls 30 and 32 of block components 13, whereby a passage of consistent design with passages 38 will be formed when corner block component 104 and block components 13 are interlocked side by side.

It will also be seen that a groove 111 and a raised ridge 112 will be provided within and on surfaces 113 and 115 of walls 106 and 108, respectively, of corner block component 104 (FIG. 14 showing only those with respect to wall 106) so that corner block component 104 may be interlocked along walls 106 and 108 with block components 13. An L-shaped groove 114 is also formed in a surface **116*a* of a connecting wall 116 of corner block component 104, substantially parallel to walls 105 and 107, so that corner block component 104 may be interlocked with an adjacent corner block component to form a corner block member by means of connecting members 50 or 56**.

Corner block components 104 preferably include at least one detent member 118 or slot 119 located along an interior surface of wall 105 and/or an interior surface of wall 107 (not shown), whereby the interlock between adjacent corner block members 117 is provided. Adjacent corner block components may be further attached by means of connecting devices inserted into their respective surface **116*b* adjacent the intersection of walls 106 and 108**.

Figure 15:
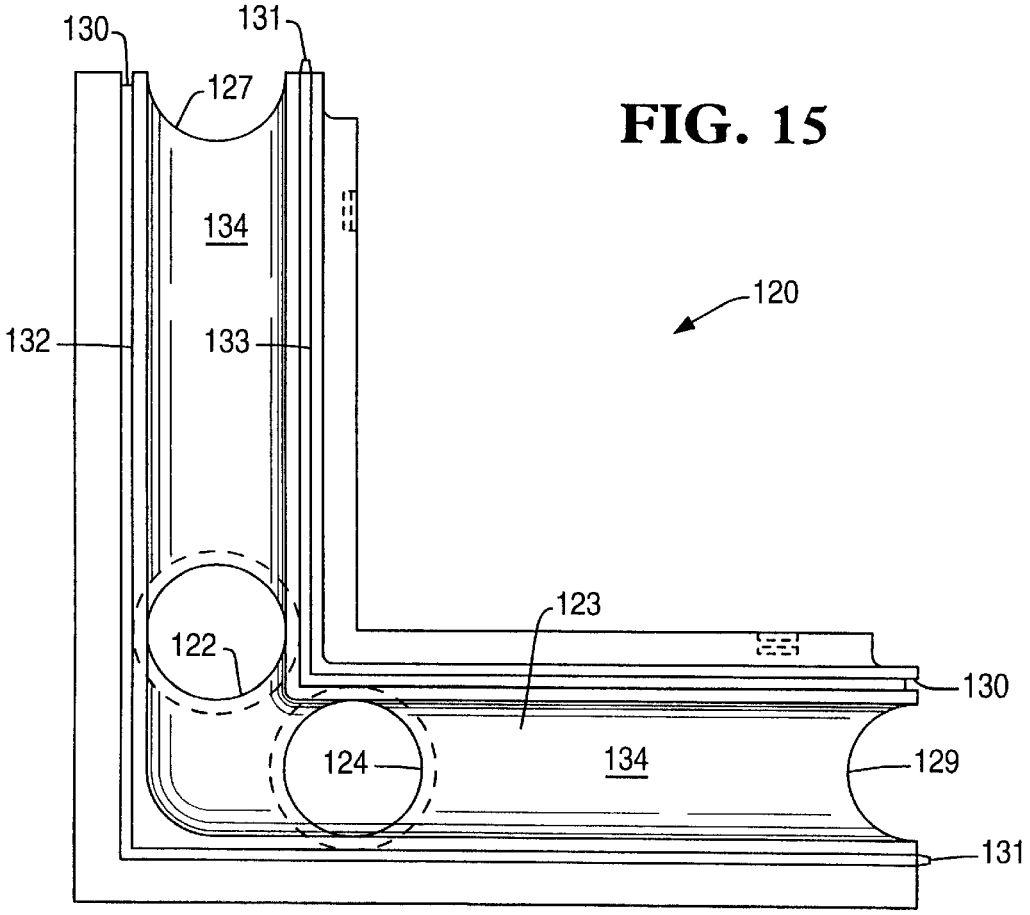
FIG. 15 is a top view of an alternative corner block member of the construction system of the present invention.

An alternate embodiment for a corner block component, designated by the numeral 120, is depicted in FIG. 15. Corner block component 120 is substantially L-shaped and includes a pair of passages 122 and 124 through a connecting wall 123 similar to passage 38 in block components 13. Like corner block component 104, corner block component 120 has a groove 130 and a raised ridge 131 positioned on surfaces 125 and 126 (not shown) of side walls 127 and 129, as well as an L-shaped groove 132 and an L-shaped raised ridge 133 formed along an exterior surface 134 of connecting wall 123 to permit corner block component 120 to be interlocked with an adjacent corner block component and form a corner block member. A plurality of detent members 128 and slots 137 are formed on an interior surface of corner block component 120 to provide the interlock for adjacent corner block members as described with respect to corner block members made up of corner block components 104 and block members 12.

As stated herein, it is contemplated that the preferred material 24 utilized to fill interconnected passages 18 and 20 will be poured concrete. Accordingly, it is preferred that a plurality of rebar elements 136 be positioned within interconnected passages 18 and 20 to further enhance the integrity of structure 10 in accordance with known construction techniques. For example, it will be preferred that such rebar elements 136 extend from footer 66 through openings 78 in base member 68 (see FIGS. 1 and 2A) and thereafter are connected to other rebar elements 136 within vertical passages 18 of structure 10. In this manner, structure 10 is able to gain a better connection with footer 66 and take advantage of the support therefrom. Rebar elements 136*a* will also preferably be provided within horizontal passages 20 in structure 10, which may be connected to rebar elements 136 at intersection points to provide mutual support.

In order to maintain rebar elements 136 and 136*a* in position, a rebar support insert 138 is preferably positioned intermittently within vertical passages 18 and horizontal passages 20. Rebar support inserts 138 are sized so as to provide a snug fit within passages 18 and 20 and may be of different sizes and shapes depending on the respective sizes and shapes of passages 18 and 20. An exemplary rebar support insert 138 is depicted in FIG. 16 and has a grid design to permit material 24 to flow through openings 139 therein. More specifically, rebar support inserts 138 include a slotted portion 140 which extends from one side to a central retaining area 142 thereof (although slotted portion 140 may also begin at a corner of rebar support insert 138 and extend diagonally to central retaining area 142). In this way, rebar elements 136 and 136*a* may be positioned substantially within the center of passages 18 and 20 in structure 10. As noted hereinabove, centerlines a and b of passages 18 and 20 are offset slightly to allow rebar elements 136 and 136*a* to pass at intersection points.

Figure 17:
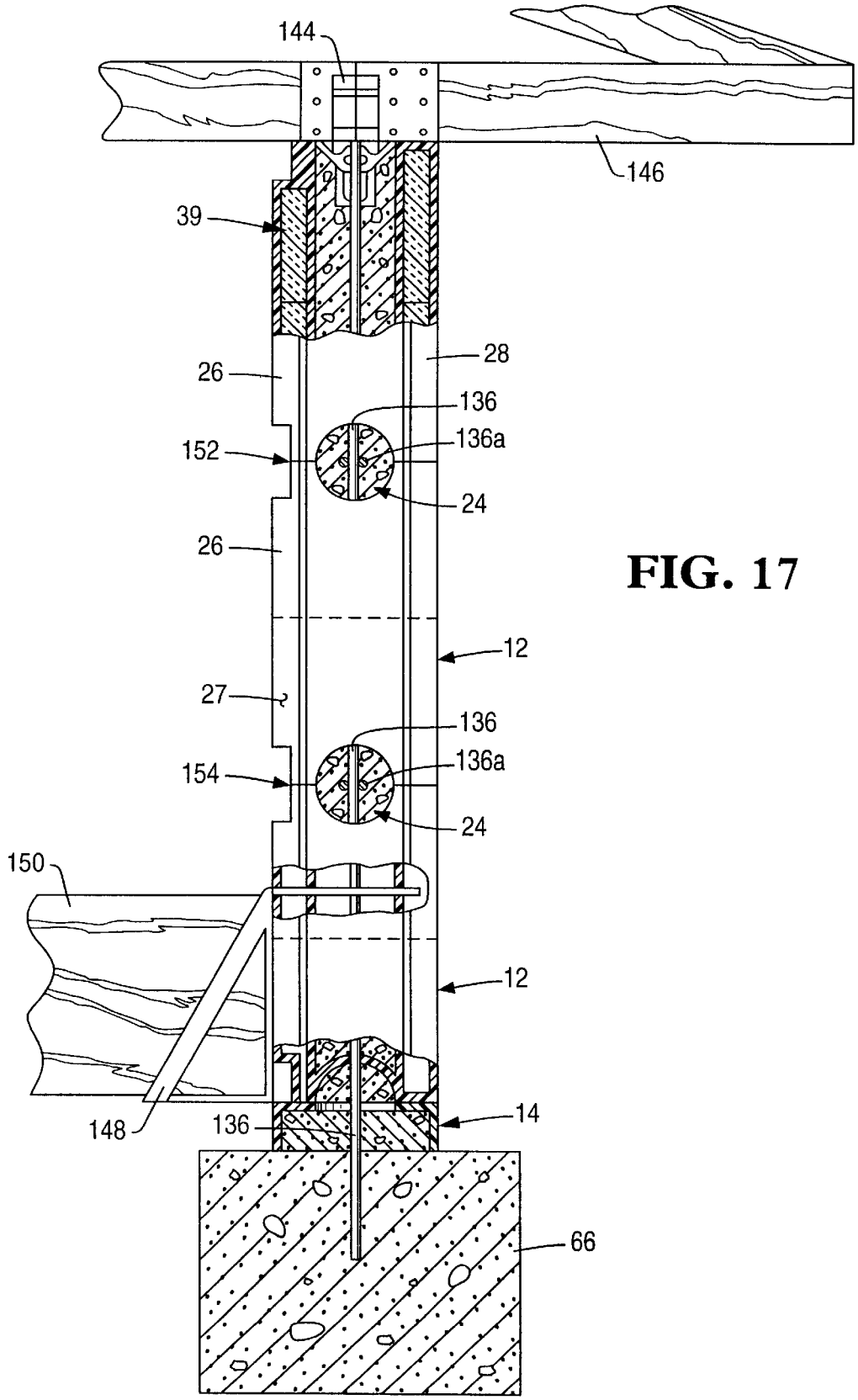
FIG. 17 is a side view, partially broken away, of the construction system of the present invention being employed in association with a truss and a joist for an enclosed structure.

It should also be understood that when the construction system of the present invention is utilized to build enclosed structures, such as a house, block members 12 and block components 13 may be arranged to provide openings for windows, doors, and the like. In addition, as seen in FIG. 17, a clip system 144 may be used to connect block members 12 with trusses 146 and an attachment system 148 can also be used to connect block members 12 with joists 150. Since truss clip system 144 and joist attachment system 148 are known by those skilled in the art, they will not be described in further detail.

In the construction of enclosed structures, it is usually advisable to increase the insulating value of the walls forming such structure. Accordingly, internal spaces 36 to each side of passage 38 within block components 13 (as seen in FIG. 7) may be filled with insulating material 39 such as a foam or treated mixture that will not absorb moisture (see FIG. 2A).

Advantageously, this construction system and method provide suitable means for distributing load forces from a first area to a second area. For example, the system and method permit a foundation footer to be extended, via concrete, through the lattice system. This, in turn, permits load forces to be distributed from, for example, a roofing structure directly into the foundation footer.

Further, the lattice system and method of the present invention facilitate reducing the ratio of concrete to surface area required when forming a structure having predetermined structural characteristics. This is primarily because when the structure and its associated lattice system are filled with a material, such as concrete, the structure has a substantially equivalent strength for a given surface area as a similar structure having a comparable surface area constructed entirely from concrete. Stated another way, a wall, for example, may be constructed having a predetermined surface area and strength with less concrete when compared to concrete walls of the past which were either formed as a concrete slab or constructed from pre-cast concrete blocks.

Further, a separate channel system may be formed along an exterior surface of front or rear walls 26 and 28 of assembled block members 12 for the placement of wiring, plumbing, or the like. As seen in FIG. 17, exemplary horizontal channels 152 and 154 are shown as being defined in front wall 26 between adjacent block components 13. This is accomplished since the textured design of front wall exterior surface 27 for each adjacent block component 13 does not meet in abutting relationship. Similarly, vertical utility channels (not seen) may be integrated into block members 12 which interconnect with horizontal channels 152 and 154. It will be understood that such horizontal and vertical utility channels may be formed at any number of locations along assembled block members 12 by merely altering the texture along the whole area of exterior surface 27. One advantage offered by the utility channels is that holes do not need to be drilled in the structure for feeding utility runs (electricity, plumbing, etc.). Also, it will be appreciated that utility conduits (wire, pipes, etc.) can be attached within the utility channels by any number of fasteners (e.g., staples, screws, etc.) due to the nature of the material used for block members 12 and block components 13.

Having shown and described the preferred embodiment of the present invention, further adaptations of the construction system of the present invention can be accomplished by appropriate modifications by one of ordinary skill in the art without departing from the scope of the invention.

What is claimed is:

1. A method of constructing a finished rigid polymer structure for receiving material comprising the steps of:

assembling a plurality of Polymer block member to define said finished polymer structure comprising a lattice of passages;

situating a plurality of joist hangers in said lattice of passages such that they are captured in said material; and introducing said material in said lattice of passages such that said material captures said plurality of joist hangers.

2. The method as recited in claim 1 wherein said method further comprises the step of:

assembling said plurality of block members to define a predetermined surface texture.

3. The method as recited in claim 1 wherein said method further comprises the step of:

providing a plurality of block members each having anechoic baffles on a surface thereof;

assembling said plurality of block members such that they define a wall having a desired baffle pattern.

4. The method as recited in claim 1 wherein said method comprises the step of:

assembling said plurality of block members such that they define a wall having an interrupted anechoic baffle pattern.

5. The method as recited in claim 1 wherein said method further comprises the step of:

assembling said Plurality of block members such that they define a wall having at least one utility run when assembled.

6. The method as recited in claim 1 wherein said method comprises the step of:

securing a polymer block support base member on a foundation footer;

mounting at least one of said plurality of block members on said polymer block support base member.

7. The method as recited in claim 6 wherein said method comprises the steps of:

pouring said material into said lattice system to extend said foundation footer such that said material can directly support a roofing structure.

8. The method as recited in claim 1 wherein said method comprises the step of:

filling said lattice of passages with a material to vertically extend a foundation footer to transfer a load from a roofing structure, through said material, to said foundation footer.

9. The method as recited in claim 1 wherein said method further comprises the step of:

situating a plurality of joists on said plurality of joist hangers;

said joist hangers being generally Z-shaped.

10. The method as recited in claim 1 wherein said method further comprises the steps of:

inserting at least one support for receiving and substantially centering a rebar member in said lattice of passages;

situating said rebar member in said at least one support so that it becomes substantially centered.

* * * * *

UNITED STATES PATENT AND TRADEMARK OFFICE

CERTIFICATE OF CORRECTION

PATENT NO. : 5,771,654
DATED : June 30, 1998
INVENTOR(S) : Moore et al.

It is certified that error appears in the above-identified patent and that said Letters Patent is hereby corrected as shown below:

Claim 1, column 10, line 32, please delete "polymer" and insert --polymer-- therefor.

Claim 1, column 10, line 32, please delete "member" and insert --members-- therefor.

Claim 7, column 11, line 3, please delete "system" and insert --of passages-- therefor.

Signed and Sealed this

Third Day of July, 2001

*Attest:*

Nicholas P. Godici

*Attesting Officer*

NICHOLAS P. GODICI
*Acting Director of the United States Patent and Trademark Office*